US011373800B2

(12) United States Patent
Arai et al.

(10) Patent No.: US 11,373,800 B2
(45) Date of Patent: Jun. 28, 2022

(54) MAGNETIC COUPLING COIL COMPONENT

(71) Applicant: TAIYO YUDEN CO., LTD., Tokyo (JP)

(72) Inventors: Takayuki Arai, Tokyo (JP); Masanori Nagano, Tokyo (JP); Akihisa Matsuda, Tokyo (JP); Daisuke Yamaguchi, Tokyo (JP); Naoya Terauchi, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 885 days.

(21) Appl. No.: 16/161,628

(22) Filed: Oct. 16, 2018

(65) Prior Publication Data

US 2019/0131063 A1 May 2, 2019

(30) Foreign Application Priority Data

Oct. 30, 2017 (JP) ..... JP2017-209566

(51) Int. Cl.
*H01F 27/34* (2006.01)
*H01F 17/00* (2006.01)
(Continued)

(52) U.S. Cl.
CPC ..... *H01F 27/346* (2013.01); *H01F 17/0013* (2013.01); *H01F 27/2804* (2013.01);
(Continued)

(58) Field of Classification Search
CPC ..... H01F 27/346; H01F 17/0013
See application file for complete search history.

(56) References Cited

U.S. PATENT DOCUMENTS 5,250,923 A 10/1993 Ushiro et al.
2010/0033286 A1* 2/2010 Katayama ..... B32B 18/00 336/200
(Continued)

FOREIGN PATENT DOCUMENTS

JP H05-190363 A 7/1993
JP H11-224817 A 8/1999
(Continued)

OTHER PUBLICATIONS

Notice of Reasons for Refusal dated Oct. 5, 2021 issued in corresponding Japanese Patent Application No. 2017-209566, with English translation (13 pgs.).
(Continued)

*Primary Examiner* — Elvin G Enad
*Assistant Examiner* — Malcolm Barnes
(74) *Attorney, Agent, or Firm* — Pillsbury Winthrop Shaw Pittman, LLP

(57) ABSTRACT

A magnetic coupling coil component according to one embodiment of the present invention includes: an insulating layer; a first coil conductor embedded in the insulating layer, the first coil conductor having a first top coil surface and a first bottom coil surface; a second coil conductor embedded in the insulating layer, the second coil conductor having a second top coil surface and a second bottom coil surface; a first cover layer provided on a first surface of the insulating layer so as to be opposed to the first top coil surface; and a second cover layer provided on a second surface of the insulating layer opposite to the first surface so as to be opposed to the second bottom coil surface. At least one of the first cover layer and the second cover layer has a magnetic permeability higher than a magnetic permeability of the insulating layer.

12 Claims, 5 Drawing Sheets

(51) Int. Cl.
*H01F 27/32* (2006.01)
*H01F 27/28* (2006.01)

(52) U.S. Cl.
CPC ... *H01F 27/327* (2013.01); *H01F 2017/0066* (2013.01); *H01F 2027/2809* (2013.01)

(56) References Cited

U.S. PATENT DOCUMENTS

2013/0229253 A1* 9/2013 Inui ..... H01F 17/0013 336/200
2013/0234819 A1* 9/2013 Yoo ..... H01F 17/0013 336/200
2014/0191838 A1* 7/2014 Yoshida ..... H01F 27/2804 336/200
2016/0078997 A1* 3/2016 Son ..... H01F 17/0033 174/260
2018/0061561 A1* 3/2018 Sim ..... H01F 17/04
2018/0158592 A1* 6/2018 Yazaki ..... H01F 27/29
2018/0254139 A1* 9/2018 Yazaki ..... H01F 27/24

FOREIGN PATENT DOCUMENTS

JP 2005-268603 A 9/2005
JP 2005-306696 A 11/2005
JP 2006-294723 A 10/2006
JP 2007-103477 A 4/2007
JP 2013055232 A * 3/2013
JP 2016-131208 A 7/2016
JP 2016131208 A * 7/2016

OTHER PUBLICATIONS

Office Action dated Apr. 19, 2022 issued in corresponding Japanese Patent Application No. 2017-209566, with English translation (8 pgs).

* cited by examiner

MAGNETIC COUPLING COIL COMPONENT

CROSS-REFERENCE TO RELATED APPLICATIONS

This application is based on and claims the benefit of priority from Japanese Patent Application Serial No. 2017-209566 (filed on Oct. 30, 2017), the contents of which are hereby incorporated by reference in their entirety.

TECHNICAL FIELD

The present invention relates to a magnetic coupling coil component.

BACKGROUND

A magnetic coupling coil component includes a pair of coil conductors magnetically coupled to each other. Examples of magnetic coupling coil element include a common mode choke coil, a transformer, and a coupled inductor. Typically, in a magnetic coupling coil component, it is preferable that the coupling between the pair of coil conductors is enhanced.

A magnetic coupling coil component produced by a lamination process is disclosed in Japanese Patent Application Publication No. 2016-131208. This coupling coil component includes a plurality of coil units embedded in an insulator. The plurality of coil units are joined together such that the winding axes of the coil conductors of the coil units are substantially aligned with each other and the coil units are tightly contacted with each other, thereby enhancing the coupling between the coil conductors.

In conventional magnetic coupling coil components, there are leakage flux flowing from coil conductors into an external space and leakage flux passing between two coil conductors. Such leakage flux may degrade the coupling in the magnetic coupling coil components.

SUMMARY

One object of the present invention is to provide a magnetic coupling coil component having improved coupling. Other objects of the present invention will be made apparent through description in the entire specification.

A magnetic coupling coil component according to one embodiment of the present invention comprises: an insulating layer; a first coil conductor embedded in the insulating layer, the first coil conductor having a first top coil surface and a first bottom coil surface; a second coil conductor embedded in the insulating layer, the second coil conductor having a second top coil surface and a second bottom coil surface; a first cover layer provided on a first surface of the insulating layer so as to be opposed to the first top coil surface; and a second cover layer provided on a second surface of the insulating layer opposite to the first surface so as to be opposed to the second bottom coil surface. In the embodiment, at least one of the first cover layer and the second cover layer has a magnetic permeability higher than a magnetic permeability of the insulating layer. It is possible that both the first cover layer and the second cover layer have a magnetic permeability higher than a magnetic permeability of the insulating layer.

According to the embodiment, the first cover layer has a magnetic permeability higher than that of the insulating layer, and therefore, the magnetic flux generated from the first coil conductor embedded in the insulating layer and entering the first cover layer easily flows in the first cover layer. Thus, less magnetic flux leaks from the first cover layer to the outside of the magnetic coupling coil component. The magnetic flux having passed through the first cover layer flows through the insulating layer and the second cover layer and is linked with the second coil conductor. When the second cover layer also has a magnetic permeability higher than that of the insulating layer, the magnetic flux less easily leaks from the second cover layer to the outside of the magnetic coupling coil component. As described above, in the embodiment, less magnetic flux leaks from at least one of the first cover layer and the second cover layer to the outside, resulting in improved coupling in the magnetic coupling coil component.

In one embodiment of the present invention, the insulating layer includes a first region between the first bottom coil surface and the second top coil surface, a second region between the first region and the first cover layer, and a third region between the first region and the second cover layer. In the embodiment, a magnetic permeability of the first region is lower than at least one of a magnetic permeability of the second region and a magnetic permeability of the third region. It is possible that a magnetic permeability of the first region is lower than both a magnetic permeability of the second region and a magnetic permeability of the third region.

According to the embodiment, the magnetic flux generated from the first coil conductor less easily flows in the first region between the first coil conductor and the second coil conductor and easily flows in the closed magnetic path linked with the second coil conductor. As a result, yet less magnetic flux leaks by passing between the first coil conductor and the second coil conductor. Accordingly, the coupling in the magnetic coupling coil component is further improved.

A magnetic coupling coil component according to another embodiment of the present invention comprises: an insulating layer; a first coil conductor embedded in the insulating layer, the first coil conductor having a first top coil surface and a first bottom coil surface; a second coil conductor embedded in the insulating layer, the second coil conductor having a second top coil surface and a second bottom coil surface; a first cover layer provided on a top surface of the insulating layer so as to be opposed to the first top coil surface; and a second cover layer provided on a bottom surface of the insulating layer so as to be opposed to the second bottom coil surface. In the embodiment, the insulating layer includes a first region between the first bottom coil surface and the second top coil surface, a second region between the first region and the first cover layer, and a third region between the first region and the second cover layer, and a magnetic permeability of the first region is lower than at least one of a magnetic permeability of the second region and a magnetic permeability of the third region. It is possible that a magnetic permeability of the first region is lower than both a magnetic permeability of the second region and a magnetic permeability of the third region.

According to the embodiment, less magnetic flux leaks by passing between the first coil conductor and the second coil conductor. Accordingly, the coupling in the magnetic coupling coil component according to the embodiment is improved.

In one embodiment of the present invention, the first bottom coil surface of the first coil conductor contacts with the first region, and the second top coil surface of the second coil conductor contacts with the first region.

According to the embodiment, both the first coil conductor and the second coil conductor contact with the first region having a low magnetic permeability, and therefore, there is no member having a high magnetic permeability between the first coil conductor and the first region and between the second coil conductor and the first region. As a result, yet less magnetic flux leaks by passing between the first coil conductor and the second coil conductor.

In one embodiment of the present invention, the insulating layer includes a plurality of insulating films stacked together, a first insulating film, which is one of the plurality of insulating films, has a conductive pattern constituting a part of the first coil conductor, the insulating layer further includes a fourth region disposed between the first region and the second region and including the first insulating film, and a magnetic permeability of the fourth region is lower than the magnetic permeability of the second region. In one embodiment of the present invention, a second insulating film, which is one of the plurality of insulating films, has a conductive pattern constituting a part of the second coil conductor, the insulating layer further includes a fifth region disposed between the first region and the third region and including the second insulating film, and a magnetic permeability of the fifth region is lower than the magnetic permeability of the third region.

The conductive patterns formed on the plurality of insulating films constituting the insulating layer are wound for less than one turn. Accordingly, in the first insulating film included in the fourth region closer to the first region than the second region, magnetic flux easily leaks from a portion of the first insulating film in which the conductive pattern is absent and passes between the first coil conductor and the second coil conductor. According to the embodiment, the magnetic permeability of the fourth region including the first insulating film is lower than that of the second region, and therefore, less magnetic flux leaks by passing between the first coil conductor and the second coil conductor. Likewise, in the second insulating film included in the fifth region closer to the first region than the third region, magnetic flux easily leaks from a portion of the second insulating film in which the conductive pattern is absent and passes between the first coil conductor and the second coil conductor. According to the embodiment, the magnetic permeability of the fifth region including the second insulating film is lower than that of the third region, and therefore, less magnetic flux leaks by passing between the first coil conductor and the second coil conductor.

ADVANTAGES

According to one embodiment of the present invention, a magnetic coupling coil component having improved coupling can be obtained.

DESCRIPTION OF THE EMBODIMENTS

Various embodiments of the invention will be described hereinafter with reference to the drawings. Elements common to a plurality of drawings are denoted by the same reference signs throughout the plurality of drawings. It should be noted that the drawings do not necessarily appear to an accurate scale, for convenience of description.

Figure 1:
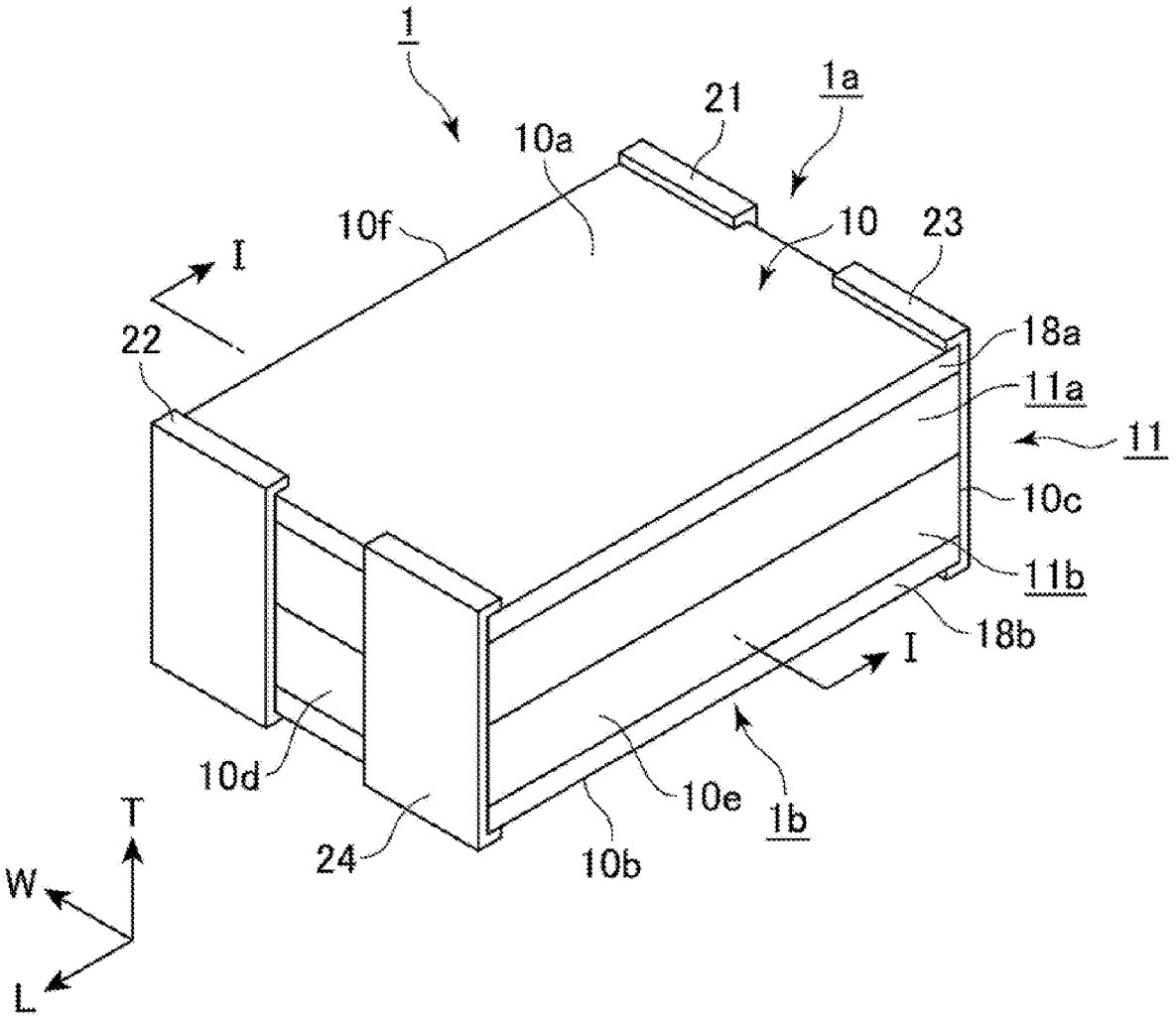
FIG. 1 is a perspective view of a coil component according to one embodiment of the present invention.
Figure 2:
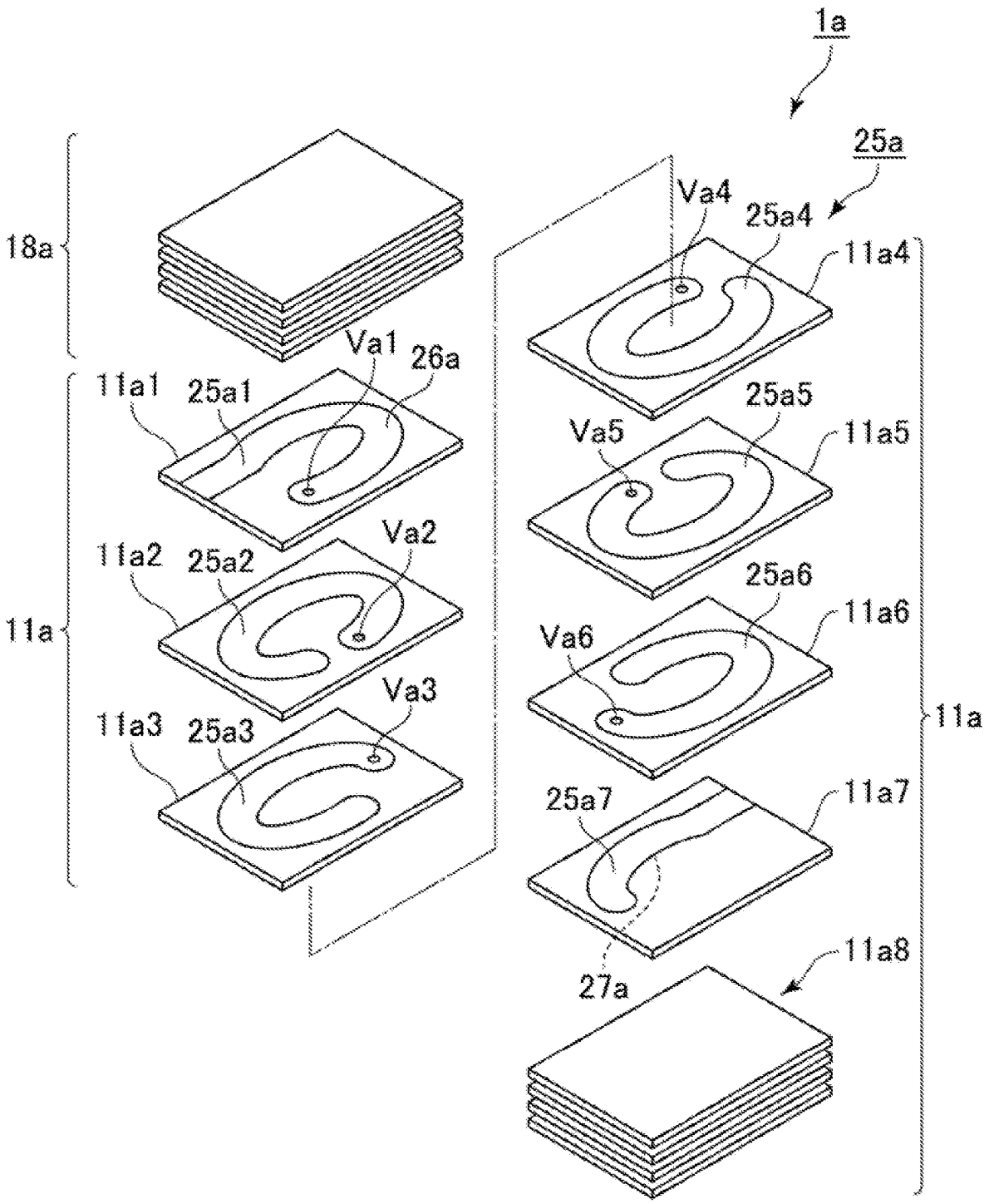
FIG. 2 is an exploded perspective view of one of two coil units included in the coil component of FIG. 1.
Figure 3:
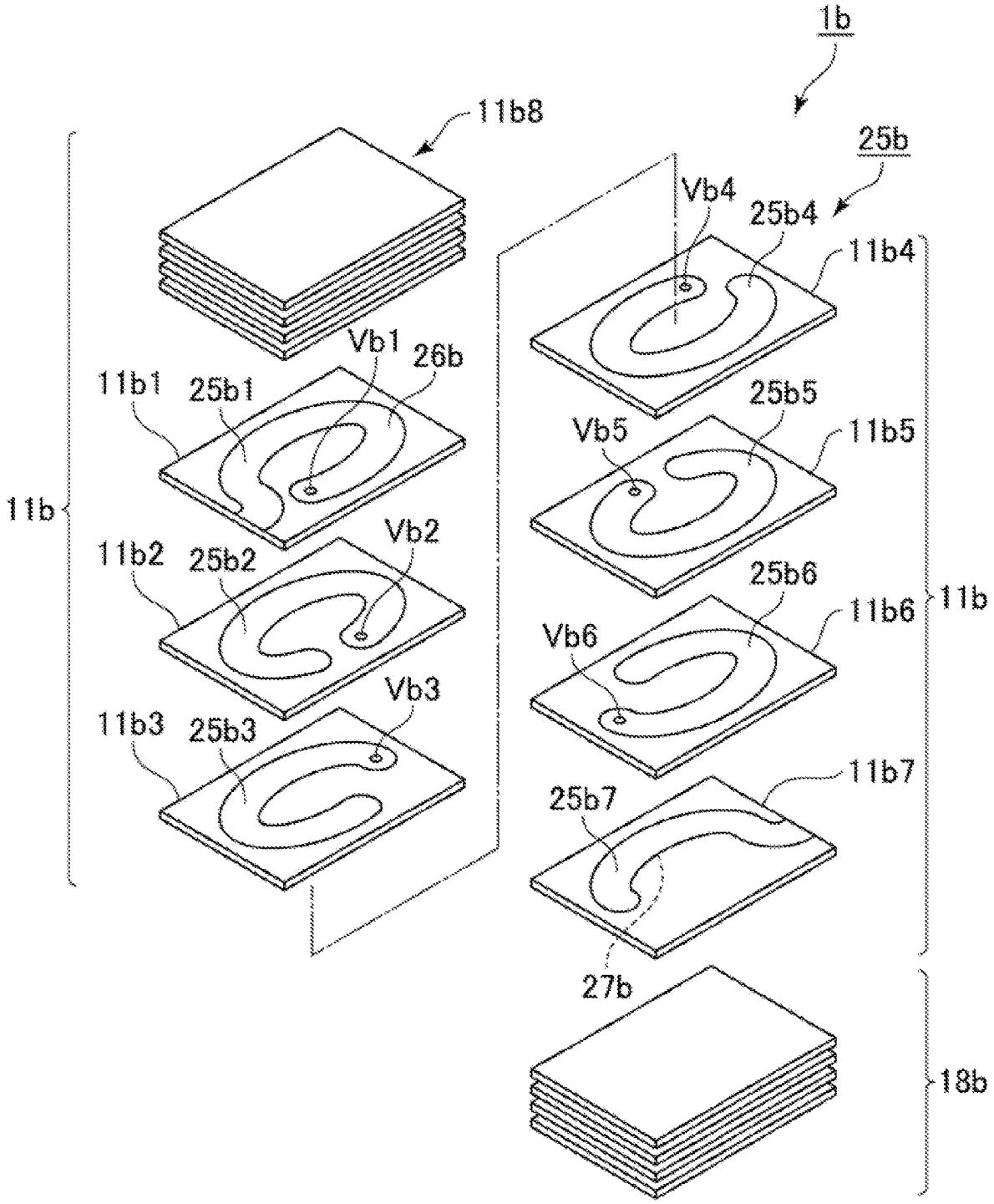
FIG. 3 is an exploded perspective view of the other of the two coil units included in the coil component of FIG. 1.
Figure 4:
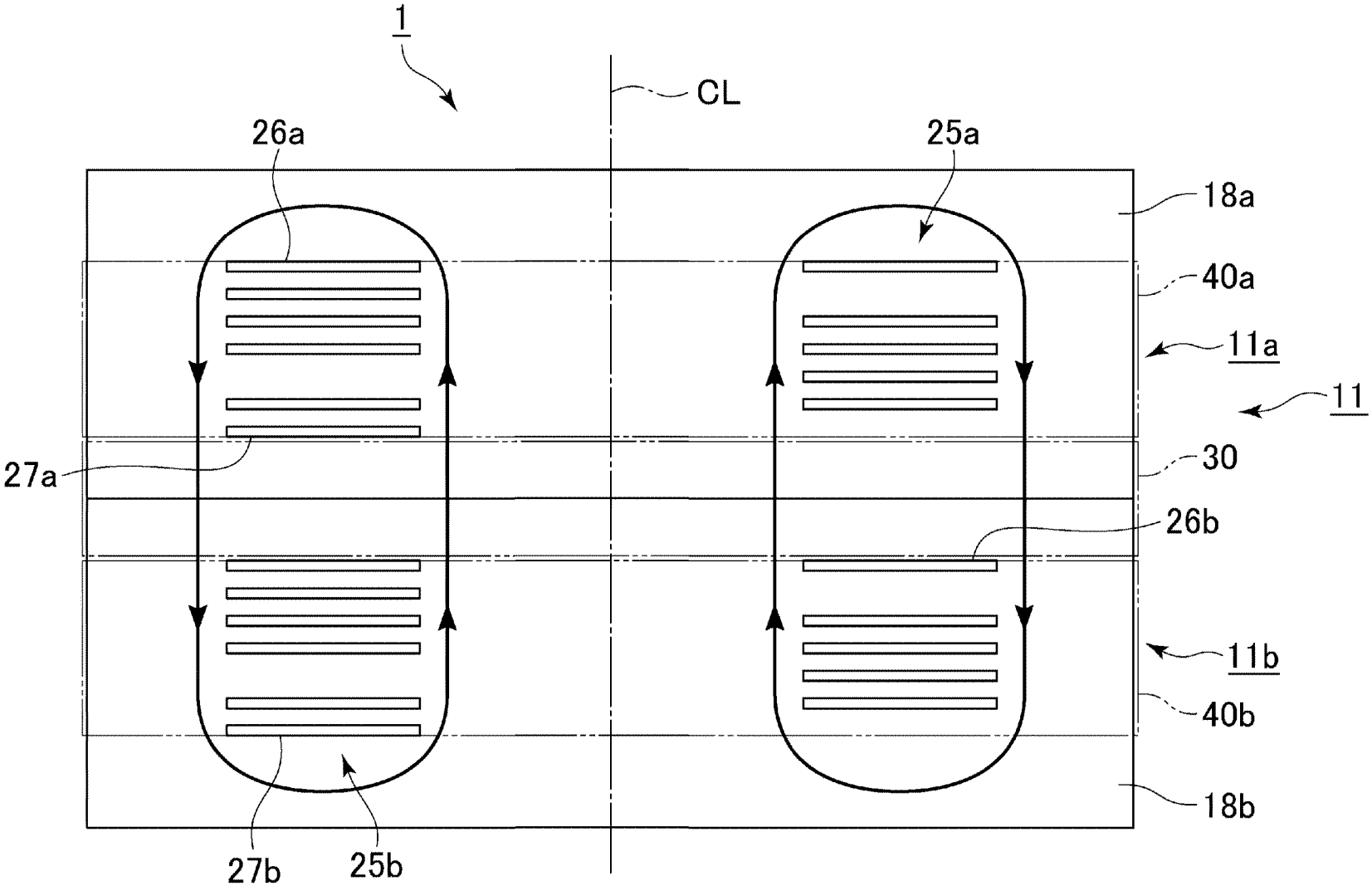
FIG. 4 schematically shows a cross section of the coil component of FIG. 1 cut along the line I-I.

A coil component 1 according to one embodiment of the present invention will be hereinafter described with reference to FIGS. 1 to 4. FIG. 1 is a perspective view of a coil component 1 according to one embodiment of the present invention, FIG. 2 is an exploded perspective view of a coil unit 1*a* included in the coil component 1 of FIG. 1, FIG. 3 is an exploded perspective view of a coil unit 1*b* included in the coil component 1 of FIG. 1, and FIG. 4 schematically shows a cross section of the coil component 1 of FIG. 1 cut along the line I-I. In FIGS. 2 to 4, the external electrodes are omitted for convenience of description.

In this specification, the "length" direction, the "width" direction, and the "thickness" direction of the coil component 1 refer to the direction "L", the direction "W", and the direction "T" in FIG. 1, respectively, unless otherwise construed from the context.

These drawings show, as one example of the coil component 1, a common mode choke coil for eliminating common mode noise from a differential transmission circuit that transmits a differential signal. A common mode choke coil is one example of a magnetic coupling coil component to which the present invention is applicable. As will be described later, a common mode choke coil is produced by a lamination process or a thin film process. The present invention can also be applied to a transformer, a coupled inductor, and other various coil components, in addition to a common mode choke coil.

As shown, the coil component 1 according to one embodiment of the present invention includes the coil unit 1*a* and the coil unit 1*b*.

The coil unit 1*a* includes an insulating layer 11*a* made of a material with an excellent insulating quality and having a rectangular parallelepiped shape, a top cover layer 18*a* made of an insulating material and provided on the top surface of the insulating layer 11*a*, a coil conductor 25*a* embedded in the insulating layer 11*a*, an external electrode 21 electrically connected to one end of the coil conductor 25*a*, and an external electrode 22 electrically connected to the other end of the coil conductor 25*a*. Depending on the production method of the coil unit 1*a*, the boundary between the insulating layer 11*a* and the top cover layer 18*a* may not be clear.

The coil unit 1*b* is configured in the same manner as the coil unit 1*a*. More specifically, the coil unit 1*b* includes an insulating layer 11*b* made of a material with an excellent insulating quality and having a rectangular parallelepiped shape, a bottom cover layer 18*b* made of an insulating material and provided on the bottom surface of the insulating layer 11*b*, a coil conductor 25*b* embedded in the insulating layer 11*b*, an external electrode 23 electrically connected to one end of the coil conductor 25*b*, and an external electrode 24 electrically connected to the other end of the coil conductor 25*b*. Depending on the production method of the coil unit 1*b*, the boundary between the insulating layer 11*b* and the bottom cover layer 18*b* may not be clear.

The bottom surface of the insulating layer 11*a* is joined to the top surface of the insulating layer 11*b*. The insulating layer 11*a* and the insulating layer 11*b* constitute an insulating layer 11.

The insulating layer 11*a*, the insulating layer 11*b*, the top cover layer 18*a*, and the bottom cover layer 18*b* constitute an insulator body 10. In the embodiment shown, the insulator body 10 includes the bottom cover layer 18*b*, the insulating layer 11*b*, the insulating layer 11*a*, and the top cover layer 18*a* that are stacked together from the negative side to the positive side in the direction of the axis T.

The insulator body 10 has a first principal surface 10*a*, a second principal surface 10*b*, a first end surface 10*c*, a second end surface 10*d*, a first side surface 10*e*, and a second side surface 10*f*. The outer surface of the insulator body 10 is defined by these six surfaces. The first principal surface 10*a* and the second principal surface 10*b* are opposed to each other, the first end surface 10*c* and the second end surface 10*d* are opposed to each other, and the first side surface 10*e* and the second side surface 10*f* are opposed to each other.

In FIG. 1, the first principal surface 10*a* lies on the top side of the insulator body 10, and therefore, the first principal surface 10*a* may be herein referred to as "the top surface." Similarly, the second principal surface 10*b* may be referred to as "the bottom surface." The coil component 1 is disposed such that the second principal surface 10*b* faces a circuit board (not shown), and therefore, the second principal surface 10*b* may be herein referred to as "the mounting surface." Furthermore, the top-bottom direction of the coil component 1 is based on the top-bottom direction in FIG. 1.

The external electrode 21 and the external electrode 23 are provided on the first end surface 10*c* of the insulator body 10. The external electrode 22 and the external electrode 24 are provided on the second end surface 10*d* of the insulator body 10. As shown, each of these external electrodes extends onto the top surface and the bottom surface of the insulator body 10. The shape and the arrangement of the external electrodes are not limited to those shown in the drawing. For example, it is also possible that the external electrodes 21 to 24 are all provided on the bottom surface 10*b* of the insulator body 10. In this case, the coil conductor 25*a* and the coil conductor 25*b* are connected, via the via conductors, to the external electrodes 21 to 24 provided on the bottom surface 10*b* of the insulator body 10.

Next, a further description is given of the coil unit 1*a*, mainly with reference to FIG. 2. As shown in FIG. 2, the insulating layer 11*a* provided in the coil unit 1*a* includes insulating films 11*a*1 to 11*a*7 and an insulating laminate 11*a*8. The insulating layer 11*a* includes the insulating film 11*a*1, the insulating film 11*a*2, the insulating film 11*a*3, the insulating film 11*a*4, the insulating film 11*a*5, the insulating film 11*a*6, the insulating film 11*a*7, and the insulating laminate 11*a*8 that are stacked in this order from the positive side to the negative side in the direction of the axis T.

The insulating films 11*a*1 to 11*a*7 are made of a material having an excellent insulating quality. The magnetic materials used for the insulating films 11*a*1 to 11*a*7 include ferrite materials, soft magnetic alloy materials, composite materials including a large number of filler particles dispersed in a resin, or any other known magnetic materials. The non-magnetic materials used for the insulating films 11*a*1 to 11*a*7 include inorganic material particles such as $SiO_2$ and $Al_2O_3$ (glass-based particles), composite materials including inorganic material particles such as $SiO_2$ and $Al_2O_3$ (glass-based particles) dispersed in a resin, resins, or glass materials.

Examples of the ferrite materials used for the insulating films 11*a*1 to 11*a*7 include a Ni—Zn-based ferrite, a Ni—Zn—Cu-based ferrite, a Mn—Zn-based ferrite, or any other ferrite materials.

Examples of the soft magnetic alloy materials used for the insulating films 11*a*1 to 11*a*7 include a Fe—Si-based alloy, a Fe—Ni-based alloy, a Fe—Co-based alloy, a Fe—Cr—Si-based alloy, a Fe—Si—Al-based alloy, a Fe—Si—B—Cr-based alloy, or any other soft magnetic alloy materials.

When the insulating films 11*a*1 to 11*a*7 are made of a composite material including a large number of filler particles dispersed in a resin, the resin may be a thermosetting resin having an excellent insulating quality, examples of which include an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, or a polybenzoxazole (PBO) resin. The filler particles may be particles of a ferrite material, metal magnetic particles, particles of an inorganic material such as $SiO_2$ or $Al_2O_3$, glass-based particles, or any other known filler particles. Particles of a ferrite material applicable to the present invention are, for example, particles of Ni—Zn ferrite or particles of Ni—Zn—Cu ferrite. Metal magnetic particles applicable to the present invention are, for example, particles of (1) metals such as Fe or Ni, (2) alloys such as Fe—Si—Cr, Fe—Si—Al, or Fe—Ni, (3) amorphous materials such as Fe—Si—Cr—B—C or Fe—Si—B—Cr, or a mixture thereof.

On the top surfaces of the insulating films 11*a*1 to 11*a*7, there are provided conductive patterns 25*a*1 to 25*a*7, respectively. The conductive patterns 25*a*1 to 25*a*7 are formed by applying a conductive paste made of a metal or alloy having an excellent electrical conductivity by screen printing. The conductive paste may be made of Ag, Pd, Cu, Al, or alloys thereof. The conductive patterns 25*a*1 to 25*a*7 may be formed by other methods using other materials. For example, the conductive patterns 25*a*1 to 25*a*7 may be formed by sputtering, ink-jetting, or other known methods.

The insulating films 11*a*1 to 11*a*6 are provided with vias Va1 to Va6, respectively, at predetermined positions therein. The vias Va1 to Va6 are formed by drilling through-holes at predetermined positions in the insulating films 11*a*1 to 11*a*6 so as to extend through the insulating films 11*a*1 to 11*a*6 in the direction of the axis T and filling a conductive material into the through-holes.

Each of the conductive patterns 25*a*1 to 25*a*7 is electrically connected to adjacent ones via the vias Va1 to Va6. The conductive patterns 25*a*1 to 25*a*7 connected in this manner constitute the coil conductor 25*a* having a spiral shape. In other words, the coil conductor 25*a* includes the conductor patterns 25*a*1 to 25*a*7 and the vias Va1 to Va6.

The end of the conductive pattern 25*a*1 opposite to the other end connected to the via Va1 is connected to the external electrode 22. The end of the conductive pattern 25*a*7 opposite to the other end connected to the via Va6 is connected to the external electrode 21.

The coil conductor 25*a* has a top coil surface 26*a* and a bottom coil surface 27*a*, the top coil surface 26*a* constituting one end of the coil conductor 25*a* in the direction of the axis T, the bottom coil surface 27*a* constituting the other end of the coil conductor 25*a* in the direction of the axis T.

The insulating laminate 11*a*8 may include a plurality of insulating films stacked together. As with the insulating films 11*a*1 to 11*a*7, the insulating films constituting the insulating laminate 11*a*8 may be made of various magnetic materials or non-magnetic materials. The magnetic materials used for the insulating films constituting the insulating laminate 11*a*8 include ferrite materials, soft magnetic alloy materials, composite materials including a large number of filler particles dispersed in a resin, or any other known magnetic materials. The non-magnetic materials used for the insulating films constituting the insulating laminate 11*a*8 include inorganic material particles such as $SiO_2$ and $Al_2O_3$ (glass-based particles), composite materials including inorganic material particles such as $SiO_2$ and $Al_2O_3$ (glass-based particles) dispersed in a resin, resins, or glass materials.

As with the insulating laminate 11*a*8, the top cover layer 18*a* may be a laminate including a plurality of insulating films stacked together. As with the insulating films 11*a*1 to 11*a*7, the insulating films constituting the top cover layer 18*a* may be made of various magnetic materials or non-magnetic materials. The magnetic materials used for the insulating films constituting the top cover layer 18*a* include ferrite materials, composite materials including a large number of filler particles dispersed in a resin, or any other known magnetic materials. The non-magnetic materials used for the insulating films constituting the top cover layer 18*a* include inorganic material particles such as $SiO_2$ and $Al_2O_3$ (glass-based particles), composite materials including inorganic material particles such as $SiO_2$ and $Al_2O_3$ (glass-based particles) dispersed in a resin, resins, or glass materials.

The top cover layer 18*a* is disposed on the top surface of the insulating layer 11*a* so as to be opposed to the top coil surface 26*a* of the coil conductor 25*a*.

Next, a further description is given of the coil unit 1*b*, mainly with reference to FIG. 3. As shown in FIG. 3, the insulating layer 11*b* provided in the coil unit 1*b* includes insulating films 11*b*1 to 11*b*7 and an insulating laminate 11*b*8 that are stacked together. The insulating layer 11*b* includes the insulating laminate 11*b*8, the insulating film 11*b*1, the insulating film 11*b*2, the insulating film 11*b*3, the insulating film 11*b*4, the insulating film 11*b*5, the insulating film 11*b*6, and the insulating film 11*b*7 that are stacked in this order from the positive side to the negative side in the direction of the axis T.

On the top surfaces of the insulating films 11*b*1 to 11*b*7, there are provided conductive patterns 25*b*1 to 25*b*7, respectively. The conductive patterns 25*b*1 to 25*b*7 are formed by applying a conductive paste made of a metal or alloy having an excellent electrical conductivity by screen printing. The conductive paste may be made of Ag, Pd, Cu, Al, or alloys thereof. The conductive patterns 25*b*1 to 25*b*7 may be formed by other methods using other materials. For example, the conductive patterns 25*b*1 to 25*b*7 may be formed by sputtering, ink-jetting, or other known methods.

The insulating films 11*b*1 to 11*b*6 are provided with vias Vb1 to Vb6, respectively, at predetermined positions therein. The vias Vb1 to Vb6 are formed by drilling through-holes at predetermined positions in the insulating films 11*b*1 to 11*b*6 so as to extend through the insulating films 11*b*1 to 11*b*6 in the direction of the axis T and filling a conductive material into the through-holes.

Each of the conductive patterns 25*b*1 to 25*b*7 is electrically connected to adjacent ones via the vias Vb1 to Vb6. The conductive patterns 25*b*1 to 25*b*7 connected in this manner constitute the coil conductor 25*b* having a spiral shape. In other words, the coil conductor 25*b* includes the conductor patterns 25*b*1 to 25*b*7 and the vias Vb1 to Vb6.

The end of the conductive pattern 25*b*1 opposite to the other end connected to the via Vb1 is connected to the external electrode 24. The end of the conductive pattern 25*b*7 opposite to the other end connected to the via Vb6 is connected to the external electrode 23.

The insulating laminate 11*b*8 may include a plurality of insulating films stacked together.

As with the insulating laminate 11*a*8, the bottom cover layer 18*b* may be a laminate including a plurality of insulating films stacked together. The bottom cover layer 18*b* is disposed on the bottom surface of the insulating layer 11*b* so as to be opposed to the bottom coil surface 27*b* of the coil conductor 25*b*.

As with the insulating films 11*a*1 to 11*a*7, the insulating films constituting the insulating films 11*b*1 to 11*b*7, the insulating laminate 11*b*8, and the bottom cover layer 18*b* may be made of various magnetic materials or non-magnetic materials. The magnetic materials used for the insulating films constituting the insulating laminate 11*b*8 include ferrite materials, soft magnetic alloy materials, composite materials including a large number of filler particles dispersed in a resin, or any other known magnetic materials. The non-magnetic materials used for the insulating films constituting the insulating laminate 11*b*8 include inorganic material particles such as $SiO_2$ and $Al_2O_3$ (glass-based particles), composite materials including inorganic material particles such as $SiO_2$ and $Al_2O_3$ (glass-based particles) dispersed in a resin, resins, or glass materials.

It is possible that all of the insulating films constituting the insulating films 11*a*1 to 11*a*7, the insulating laminate 11*a*8, the top cover layer 18*a*, the insulating films 11*b*1 to 11*b*7, the insulating laminate 11*b*8, and the bottom cover layer 18*b* are made of a ferrite material, all of these insulating films are made of a soft magnetic alloy material, or all of these insulating films are made of a composite material including a large number of filler particles dispersed in a resin. It is also possible that a part of the insulating films constituting the insulating films 11*a*1 to 11*a*7, the insulating laminate 11*a*8, the top cover layer 18*a*, the insulating films 11*b*1 to 11*b*7, the insulating laminate 11*b*8, and the bottom cover layer 18*b* is made of a different material than other insulating films.

The coil conductor 25*b* has a top coil surface 26*b* and a bottom coil surface 27*b*, the top coil surface 26*b* constituting one end of the coil conductor 25*b* in the direction of the axis T, the bottom coil surface 27*b* constituting the other end of the coil conductor 25*b* in the direction of the axis T. The coil conductor 25*a* is disposed such that the bottom coil surface 27*a* thereof is opposed to the top coil surface 26*b* of the coil conductor 25*b*.

The coil component 1 is obtained by joining the coil unit 1*a* and the coil unit 1*b* together. The coil component 1 includes a first coil conductor (the coil conductor 25*a*) and a second coil conductor (the coil conductor 25*b*), the first coil conductor positioned between the external electrode 21 and the external electrode 22, the second coil conductor positioned between the external electrode 23 and the external electrode 24. These two coils are connected to, for example, two signal lines in a differential transmission circuit, respectively. Thus, the coil component 1 can operate as a common mode choke coil.

The coil component 1 may include a third coil (not shown). The coil component 1 having the third coil additionally includes another coil unit configured in the same manner as the coil unit 1*a*. As with the coil unit 1*a* and the coil unit 1*b*, the additional coil unit includes a coil conductor that is connected to additional external electrodes. The coil component including three coils is used as, for example, a common mode choke coil for a differential transmission circuit having three signal lines.

Next, a description is given of magnetic permeabilities at different regions of the coil component 1 with reference to FIG. 4. FIG. 4 schematically shows a cross section of the coil component of FIG. 1 cut along the line I-I. In FIG. 4, the magnetic flux (the lines of magnetic force) generated from the coil conductor is represented by arrows. In FIG. 4, the boundaries between the individual insulating layers are omitted for convenience of description.

As shown, the coil conductor 25*a* is embedded in the insulating layer 11*a* such that the top coil surface 26*a* is exposed out of the insulating layer 11*a* toward the top cover layer 18*a*. The coil conductor 25*a* is wound around the coil axis CL in the insulating layer 11*a*. The coil axis CL is an imaginary line that extends in parallel to the axis T in FIG. 1. It is also possible that the coil axis CL is perpendicular to the axis T. The coil conductor 25*b* is embedded in the insulating layer 11*b* such that the bottom coil surface 27*b* is exposed out of the insulating layer 11*b* toward the bottom cover layer 18*b*. The coil conductor 25*b* is wound around the coil axis CL, as is the coil conductor 25*a*.

The insulating layer 11 includes a first region 30, a second region 40*a*, and a third region 40*b*. The first region 30 is positioned between the bottom coil surface 27*a* of the coil conductor 25*a* and the top coil surface 26*b* of the coil conductor 25*b*, the second region 40*a* is positioned between the first region 30 and the top cover layer 18*a*, and the third region 40*b* is positioned between the first region 30 and the bottom cover layer 18*b*.

In one embodiment of the present invention, the first region 30 includes the insulating laminate 11*a*8 and the insulating laminate 11*b*8. The first region 30 may be constituted only by the insulating laminate 11*a*8 and the insulating laminate 11*b*8. The first region 30 may include an additional insulating film made of a magnetic material, in addition to the insulating laminate 11*a*8 and the insulating laminate 11*b*8. The additional insulating film may be disposed, for example, between the insulating laminate 11*a*8 and the insulating laminate 11*b*8, between the insulating laminate 11*a*8 and the insulating film 11*a*7, or between the insulating laminate 11*b*8 and the insulating film 11*b*1.

In one embodiment of the present invention, the second region 40*a* includes the insulating films 11*a*1 to 11*a*7. The second region 40*a* may be constituted only by the insulating films 11*a*1 to 11*a*7. The second region 40*a* may include an additional insulating film made of a magnetic material, in addition to the insulating films 11*a*1 to 11*a*7.

In one embodiment of the present invention, the third region 40*b* includes the insulating films 11*b*1 to 11*b*7. The third region 40*b* may be constituted only by the insulating films 11*b*1 to 11*b*7. The third region 40*b* may include an additional insulating film made of a magnetic material, in addition to the insulating films 11*b*1 to 11*b*7.

The second region 40*a* may directly contact with the first region 30. The third region 40*b* may directly contact with the first region 30.

In one embodiment of the present invention, the first region 30 has a magnetic permeability μ1, the second region 40*a* has a magnetic permeability μ2, the third region 40*b* has a magnetic permeability μ3, the top cover layer 18*a* has a magnetic permeability μ4, and the bottom cover layer 18*b* has a magnetic permeability μ5.

In one embodiment of the present invention, at least one of the magnetic permeability μ4 of the top cover layer 18*a* and the magnetic permeability μ5 of the bottom cover layer 18*b* is higher than the magnetic permeability of the insulating layer 11. As described above, the insulating layer 11 includes the first region 30, the second region 40*a*, and the third region 40*b*, and therefore, at least one of the magnetic permeability μ4 of the top cover layer 18*a* and the magnetic permeability μ5 of the bottom cover layer 18*b* is higher than all of the magnetic permeability μ1 of the first region 30, the magnetic permeability μ2 of the second region 40*a*, and the magnetic permeability μ3 of the third region 40*b*. It is also possible that both the magnetic permeability μ4 of the top cover layer 18*a* and the magnetic permeability μ5 of the bottom cover layer 18*b* are higher than the magnetic permeability of the insulating layer 11.

The magnetic permeability μ4 of the top cover layer 18*a* is either the same as or different from the magnetic permeability μ5 of the bottom cover layer 18*b*.

According to the embodiment, at least one of the top cover layer 18*a* and the bottom cover layer 18*b* has a magnetic permeability higher than that of the insulating layer 11. When the top cover layer 18*a* has a magnetic permeability higher than that of the insulating layer 11, the magnetic flux generated from the coil conductor 25*a* embedded in the insulating layer 11 and entering the top cover layer 18*a* easily flows in the top cover layer 18*a*. Thus, less magnetic flux leaks from the top cover layer 18*a* to the outside of the coil component 1. When the bottom cover layer 18*b* has a magnetic permeability higher than that of the insulating layer 11, the magnetic flux generated from the coil conductor 25*b* easily flows in the bottom cover layer 18*b* and returns to the core portion of the coil conductor 25*b*. Thus, less magnetic flux leaks from the bottom cover layer 18*b* to the outside of the coil component 1. When both the top cover layer 18*a* and the bottom cover layer 18*b* have a magnetic permeability higher than that of the insulating layer 11, yet less magnetic flux leaks to the outside of the coil component 1. As described above, in the embodiment, less magnetic flux leaks from the top cover layer 18*a* and the bottom cover layer 18*b* to the outside of the coil component 1, resulting in improved coupling in the coil component 1.

In another embodiment of the present invention, the magnetic permeability μ1 of the first region 30 is lower than at least one of the magnetic permeability μ2 of the second region 40*a* and the magnetic permeability μ3 of the third region 40*b*. The magnetic permeability μ1 of the first region 30 may be lower than both of the magnetic permeability μ2 of the second region 40*a* and the magnetic permeability μ3 of the third region 40*b*. In the embodiment, the magnetic permeability μ2 of the second region 40*a* is either the same as or different from the magnetic permeability μ3 of the third region 40*b*. In the embodiment, the magnetic permeability μ2 and the magnetic permeability μ3 may be equal to, lower than, or higher than the magnetic permeability μ4. Likewise, the magnetic permeability μ2 and the magnetic permeability μ3 may be equal to, lower than, or higher than the magnetic permeability μ5. That is, for the magnetic permeabilities μ1 to μ3, one or both of the relationships μ2>μ1 and μ3>μ1 are satisfied.

In the embodiment that satisfies the above relationship μ2>μ1 or μ3>μ1, both the bottom coil surface 27*a* of the coil conductor 25*a* and the top coil surface 26*b* of the coil conductor 25*b* may contact with the first region 30, as shown in FIG. 4.

According to the embodiment that satisfies the above relationship μ2>μ1 or μ3>μ1, the magnetic flux generated from the first coil conductor 25*a* less easily flows in the first region between the first coil conductor 25*a* and the second coil conductor 25*b*. As a result, less magnetic flux leaks by passing between the first coil conductor 25*a* and the second coil conductor 25*b*. When both the relationships μ2>μ1 and μ3>μ1 are satisfied, yet less magnetic flux leaks by passing through the first region between the first coil conductor 25*a* and the second coil conductor 25*b*. Accordingly, the coupling in the magnetic coupling coil component 1 is improved.

When both the bottom coil surface 27*a* of the coil conductor 25*a* and the top coil surface 26*b* of the coil conductor 25*b* contact with the first region 30, both the coil conductor 25*a* and the coil conductor 25*b* contact with the first region 30 having a low magnetic permeability, and therefore, there is no member having a high magnetic permeability between the coil conductor 25*a* and the first region 30 and between the coil conductor 25*b* and the first region 30. As a result, yet less magnetic flux leaks by passing between the coil conductor 25*a* and the coil conductor 25*b*.

The above embodiments can be combined together as necessary. For example, it is possible that at least one of the magnetic permeability μ4 of the top cover layer 18*a* and the magnetic permeability μ5 of the bottom cover layer 18*b* is higher than that of the insulating layer 11, and the magnetic permeability μ1 of the first region 30 is lower than at least one of the magnetic permeability μ2 of the second region 40*a* and the magnetic permeability μ3 of the third region 40*b*. In this case, for example, the relationships μ4>μ2>μ1 and μ5>μ3>μ1 are satisfied.

When the first region 30 is made of a ferrite material, the magnetic permeability μ1 of the first region 30 can be adjusted as necessary by the composition of the ferrite material. For example, when the first region 30 is made of a Ni—Zn—Cu-based ferrite, the magnetic permeability μ1 of the first region 30 can be adjusted as necessary by adjusting the composition ratio between Ni and Zn. Likewise, the magnetic permeability of the second region 40*a* made of a ferrite material, the magnetic permeability of the third region 40*b* made of a ferrite material, the magnetic permeability of the top cover layer 18*a* made of a ferrite material, and the magnetic permeability of the bottom cover layer 18*b* made of a ferrite material can be adjusted as necessary by the composition of these ferrite materials.

When the first region 30 is made of a soft magnetic metal, the magnetic permeability μ1 of the first region 30 can be adjusted as necessary by the content rate of iron in the soft magnetic metal. Likewise, the magnetic permeability of the second region 40*a* made of a soft magnetic metal, the magnetic permeability of the third region 40*b* made of a soft magnetic metal, the magnetic permeability of the top cover layer 18*a* made of a soft magnetic metal, and the magnetic permeability of the bottom cover layer 18*b* made of a soft magnetic metal can be adjusted as necessary by the content rates of iron in these soft magnetic metals.

When the first region 30 is made of a resin including filler particles dispersed therein, the magnetic permeability μ1 of the first region 30 can be adjusted as necessary by the content rate of the filler particles and the material of the filler particles in the first region 30. For example, the magnetic permeability can be increased by increasing the content rate of filler particles in the first region 30, and conversely, the magnetic permeability can be reduced by reducing the content rate of filler particles in the first region 30. Further, the magnetic permeability can be increased by forming the filler particles of a material with a high magnetic permeability, and conversely, the magnetic permeability can be reduced by forming the filler particles of a material with a low magnetic permeability. Likewise, the magnetic permeability of the second region 40*a* made of a resin including filler particles dispersed therein, the magnetic permeability of the third region 40*b* made of a resin including filler particles dispersed therein, the magnetic permeability of the top cover layer 18*a* made of a resin including filler particles dispersed therein, and the magnetic permeability of the bottom cover layer 18*b* made of a resin including filler particles dispersed therein can be adjusted as necessary by the content rates of the filler particles and the material of the filler particles.

In one embodiment of the present invention, the first region 30 may have a larger resistance value than the second region 40*a* and the third region 40*b*. Thus, even when the first region 30 has a small thickness, electric insulation between the coil conductor 25*a* and the coil conductor 25*b* can be ensured. As a result, the coil component 1 can have a low profile.

Figure 5:
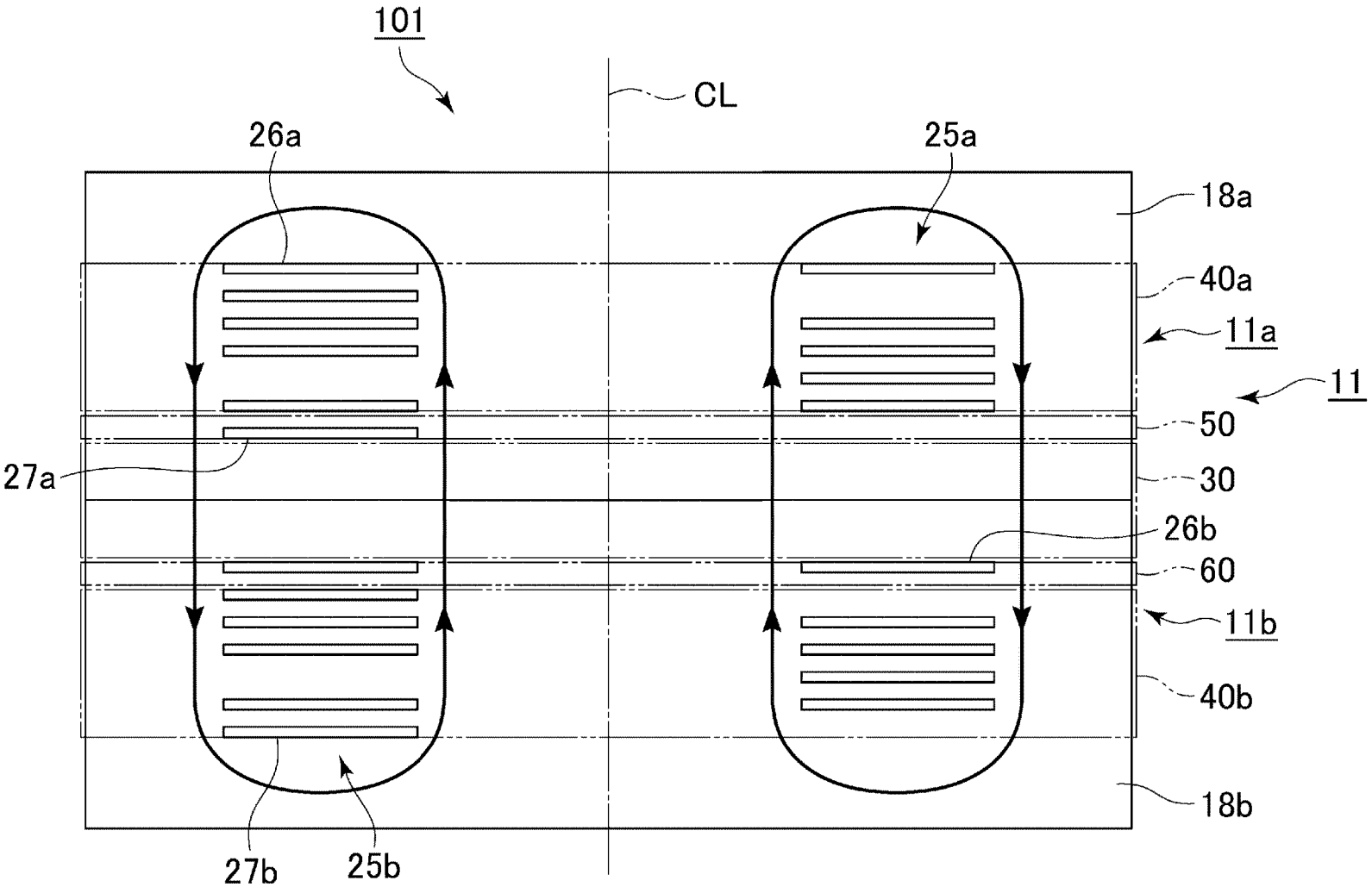
FIG. 5 schematically shows a cross section of a coil component according to another embodiment of the present invention.

Next, still another embodiment of the present invention will be described with reference to FIG. 5. FIG. 5 schematically shows a cross section of a coil component 101 according to one embodiment of the present invention. The coil component 101 shown in FIG. 5 includes a fourth region 50 and a fifth region 60. The fourth region 50 is disposed between the first region 30 and the second region 40*a*, and the fifth region 60 is disposed between the first region 30 and the third region 40*b*. The second region 40*a* is disposed between the fourth region 50 and the top cover layer 18*a*. The third region 40*b* is disposed between the fifth region 60 and the bottom cover layer 18*b*. The coil component 101 includes either one or both of the fourth region 50 and the fifth region 60.

The fourth region 50 includes the insulating film 11*a*7. The fourth region 50 may be constituted only by the insulating film 11*a*7. On the insulating film 11*a*7, there is formed the conductive pattern 25*a*7 that constitutes a part of the first coil conductor 25*a*. The fourth region 50 includes either the entirety or a part of the insulating film 11*a*7. For example, the fourth region may be constituted by a portion of the insulating film 11*a*7 in which, in a plan view, the conductive pattern 25*a*7 is absent between the coil axis CL and the periphery of the insulating film 11*a*7.

The fifth region 60 includes the insulating film 11*b*1. The fifth region 60 may be constituted only by the insulating film 11*b*1. On the insulating film 11*b*1, there is formed the conductive pattern 25*b*1 that constitutes a part of the second coil conductor 25*b*. The fifth region 60 includes either the entirety or a part of the insulating film 11*b*1. For example, the fifth region may be constituted by a portion of the insulating film 11*b*1 in which, in a plan view, the conductive pattern 25*b*1 is absent between the coil axis CL and the periphery of the insulating film 11*b*1.

The fourth region 50 has a magnetic permeability μ6. In one embodiment of the present invention, the magnetic permeability μ6 of the fourth region 50 is lower than the magnetic permeability μ2 of the second region 40*a*. In one embodiment of the present invention, the magnetic permeability μ6 of the fourth region 50 is lower than the magnetic permeability μ3 of the third region 40*b*. The magnetic permeability μ6 of the fourth region 50 may be equal to, lower than, or higher than the magnetic permeability μ1 of the first region 30.

The fifth region 60 has a magnetic permeability μ7. In one embodiment of the present invention, the magnetic permeability μ7 of the fifth region 60 is lower than the magnetic permeability μ3 of the third region 40*b*. In one embodiment of the present invention, the magnetic permeability μ7 of the fifth region 60 is lower than the magnetic permeability μ2 of the second region 40*a*. The magnetic permeability μ7 of the fifth region 60 may be equal to, lower than, or higher than the magnetic permeability μ1 of the first region 30.

The conductive pattern 25*a*7 is wound around the coil axis CL for less than one turn, and therefore, when the magnetic permeability μ6 of the fourth region 50 is equal to or lower than the magnetic permeability μ2 of the second region 40*a*, the magnetic flux passing through the cores of the first coil conductor 25*a* and the second coil conductor 25*b* easily leaks by passing through a portion of the insulating film 11*a*7 in which the conductive pattern 25*a*7 is absent. In the embodiment shown, the conductive pattern 25*a*7 is wound for a smaller number of turns than the conductive patterns 25*a*1 to 25*a*6 because it is connected with the external electrode 21. For example, in the embodiment shown in FIG. 2, each of the conductive patterns 25*a*1 to 25*a*6 is wound for about a five-sixth turn, whereas the conductive pattern 25*a*7 is wound for only about a two-fifth turn. Since the conductive pattern 25*a*7 is wound for a smaller number of turns, the magnetic flux flows more easily in the insulating film 11*a*7 in the direction perpendicular to the coil axis CL than in the insulating films 11*a*1 to 11*a*6. In the coil component 101 described above, when the magnetic permeability μ6 of the fourth region 50 that includes the insulating film 11*a*7 is lower than the magnetic permeability μ2 of the second region 40*a*, yet less magnetic flux leaks by passing between the coil conductor 25*a* and the coil conductor 25*b*.

As with the conductive pattern 25*a*7, the conductive pattern 25*b*1 is wound around the coil axis CL for less than one turn, and therefore, when the magnetic permeability μ7 of the fifth region 60 is equal to or lower than the magnetic permeability μ3 of the third region 40*b*, the magnetic flux passing through the cores of the first coil conductor 25*a* and the second coil conductor 25*b* easily leaks by passing through a portion of the insulating film 11*b*1 in which the conductive pattern 25*b*1 is absent. In the coil component 101 described above, when the magnetic permeability μ7 of the fifth region 60 that includes the insulating film 11*b*1 is lower than the magnetic permeability μ3 of the third region 40*b*, yet less magnetic flux leaks by passing between the coil conductor 25*a* and the coil conductor 25*b*.

Next, a description is given of an example of a production method of the coil component 1. The coil component 1 can be produced by, for example, a lamination process. First, the coil unit 1*a* and the coil unit 1*b* are produced.

The first step is to produce green sheets to be used as the insulating films 11*a*1 to 11*a*7, the insulating films 11*b*1 to 11*b*7, the insulating films constituting the insulating laminate 11*a*8, the insulating films constituting the insulating laminate 11*b*8, the insulating films constituting the top cover layer 18*a*, and the insulating films constituting the bottom cover layer 18*b*. These green sheets are made of, for example, a ferrite, a soft magnetic alloy, or other magnetic materials. It is hereinafter supposed that the green sheets are made of a soft magnetic alloy.

First, a slurry is prepared by mixing a binder resin and a solvent with soft magnetic metal particles made of a Fe—Si-based alloy, a Fe—Ni-based alloy, a Fe—Co-based alloy, a Fe—Cr—Si-based alloy, a Fe—Si—Al-based alloy, a Fe—Si—B—Cr-based alloy, or any other soft magnetic alloys, and the slurry is applied to the surface of a base film made of plastic. The applied slurry is dried to produce the green sheets.

Next, through-holes are formed at predetermined positions in the green sheets to be used as the insulating films 11*a*1 to 11*a*6 and the green sheets to be used as the insulating films 11*b*1 to 11*b*6, so as to extend through the green sheets in the direction of the axis T.

Next, a conductive paste is applied by screen printing onto the top surfaces of the green sheets to be used as the insulating films 11*a*1 to 11*a*7 and the top surfaces of the green sheets to be used as the insulating films 11*b*1 to 11*b*7, thereby to form conductive patterns on the green sheets. Then, a conductive paste is filled into the through-holes formed in the green sheets. The conductive patterns formed on the green sheets to be used as the insulating films 11*a*1 to 11*a*7 constitute the conductive patterns 25*a*1 to 25*a*7, respectively, and the metal filled in the through-holes forms the vias Va1 to Va6. The conductive patterns formed on the green sheets to be used as the insulating films 11*b*1 to 11*b*7 constitute the conductive patterns 25*b*1 to 25*b*7, respectively, and the metal filled in the through-holes forms the vias Vb1 to Vb6. It is also possible that the conductive patterns and the vias are formed by various known methods other than screen printing.

Next, the green sheets to be used as the insulating films 11*a*1 to 11*a*7 are stacked together to form a first coil laminate. The green sheets to be used as the insulating layers 11*a*1 to 11*a*7 are stacked together such that the conductive patterns 25*a*1 to 25*a*7 formed on the green sheets are each electrically connected to adjacent conductive patterns through the vias Va1 to Va6. Likewise, the green sheets to be used as the insulating films 11*b*1 to 11*b*7 are stacked together to form a second coil laminate. The green sheets to be used as the insulating layers 11*b*1 to 11*b*7 are stacked together such that the conductive patterns 25*b*1 to 25*b*7 formed on the green sheets are each electrically connected to adjacent conductive patterns through the vias Vb1 to Vb6.

Next, the green sheets to be used as the insulating laminate 11*a*8 are stacked together to form a first bottom laminate, the green sheets to be used as the top cover layer 18*a* are stacked together to form a first top laminate, the green sheets to be used as the insulating laminate 11*b*8 are stacked together to form a second top laminate, and the green sheets to be used as the bottom cover layer 18*b* are stacked together to form a second bottom laminate.

Next, the second bottom laminate, the second coil laminate, the second top laminate, the first bottom laminate, the first coil laminate, and the first top laminate are stacked together in this order from the negative side to the positive side in the direction of the axis T, and these stacked laminates are bonded together by thermal compression using a pressing machine to obtain a body laminate. It is also possible to form the body laminate by sequentially stacking all the prepared green sheets together and bonding the stacked green sheets together by thermal compression, without forming the second bottom laminate, the second coil laminate, the second top laminate, the first bottom laminate, the first coil laminate, and the first top laminate.

Next, the body laminate is segmented to a desired size by using a cutter such as a dicing machine or a laser processing machine to obtain a chip laminate. Next, the chip laminate is degreased and then heated. The end portions of the chip laminate is subjected to a polishing process such as barrel-polishing, if necessary.

Next, a conductive paste is applied to both end portions of the chip laminate to form the external electrode 21, the external electrode 22, the external electrode 23, and the external electrode 24. At least one of a solder barrier layer and a solder wetting layer may be provided to the external electrode 21, the external electrode 22, the external electrode 23, and the external electrode 24, if necessary. Thus, the coil component 1 is obtained.

A part of the steps included in the above production method may be omitted as necessary. In the production method of the coil component 1, steps not described explicitly in this specification may be performed as necessary. A part of the steps included in the production method of the coil component 1 may be performed in different order within the purport of the present invention. A part of the steps included in the production method of the coil component 1 may be performed at the same time or in parallel, if possible.

It is also possible that the insulating films included in the coil component 1 are constituted by insulating sheets made by temporarily setting a resin having various types of filler particles dispersed therein. Such insulating sheets do not need to be degreased.

It is also possible to produce the coil component 1 by the slurry build method or any other known methods.

The coil component 1, which is formed by the lamination process, is more susceptible to downsizing than conventional assembled coupled inductors.

The dimensions, materials, and arrangements of the various constituents described in this specification are not limited to those explicitly described for the embodiments, and the various constituents can be modified to have any dimensions, materials, and arrangements within the scope of the present invention. Constituents other than those explicitly described herein can be added to the described embodiments; and part of the constituents described for the embodiments can be omitted.

What is claimed is:

1. A magnetic coupling coil component, comprising:

an insulating layer;

a first coil conductor embedded in the insulating layer, the first coil conductor having a first top coil surface and a first bottom coil surface;

a second coil conductor embedded in the insulating layer, the second coil conductor having a second top coil surface and a second bottom coil surface, the second top coil surface being opposed to the first bottom coil surface of the first coil conductor;

a first cover layer provided on a top surface of the insulating layer so as to be opposed to the first top coil surface; and a second cover layer provided on a bottom surface of the insulating layer so as to be opposed to the second bottom coil surface, wherein the first cover layer includes a plurality of first cover insulating films stacked together, wherein the second cover layer includes a plurality of second cover insulating films stacked together, and wherein each of the plurality of first cover insulating films and each of the plurality of second cover insulating films has a magnetic permeability higher than a magnetic permeability of the insulating layer.

2. The magnetic coupling coil component of claim 1, wherein both the first cover layer and the second cover layer have a magnetic permeability higher than the magnetic permeability of the insulating layer.

3. The magnetic coupling coil component of claim 1, wherein the insulating layer includes a first region between the first bottom coil surface and the second top coil surface, a second region between the first region and the first cover layer, and a third region between the first region and the second cover layer, and a magnetic permeability of the first region is lower than at least one of a magnetic permeability of the second region and a magnetic permeability of the third region.

4. The magnetic coupling coil component of claim 3, wherein the magnetic permeability of the first region is lower than both the magnetic permeability of the second region and the magnetic permeability of the third region.

5. The magnetic coupling coil component of claim 3, wherein the insulating layer includes a plurality of insulating films stacked together, a first insulating film, which is one of the plurality of insulating films, has a conductive pattern constituting a part of the first coil conductor, the insulating layer further includes a fourth region disposed between the first region and the second region and including the first insulating film, a magnetic permeability of the fourth region is lower than the magnetic permeability of the second region.

6. The magnetic coupling coil component of claim 3, wherein the insulating layer includes a plurality of insulating films stacked together, a second insulating film, which is one of the plurality of insulating films, has a conductive pattern constituting a part of the second coil conductor, the insulating layer further includes a fifth region disposed between the first region and the third region and including the second insulating film, and a magnetic permeability of the fifth region is lower than the magnetic permeability of the third region.

7. The magnetic coupling coil component of claim 1, wherein the first bottom coil surface of the first coil conductor contacts with the first region, and the second top coil surface of the second coil conductor contacts with the first region.

8. A magnetic coupling coil component, comprising:

an insulating layer;

a first coil conductor embedded in the insulating layer, the first coil conductor having a first top coil surface and a first bottom coil surface;

a second coil conductor embedded in the insulating layer, the second coil conductor having a second top coil surface and a second bottom coil surface;

a first cover layer provided on a top surface of the insulating layer so as to be opposed to the first top coil surface; and a second cover layer provided on a bottom surface of the insulating layer so as to be opposed to the second bottom coil surface, wherein the insulating layer includes a first region between the first bottom coil surface and the second top coil surface, a second region between the first region and the first cover layer, and a third region between the first region and the second cover layer, a magnetic permeability of the first region is lower than at least one of a magnetic permeability of the second region and a magnetic permeability of the third region, and the first region of the insulating layer is formed of a magnetic material.

9. The magnetic coupling coil component of claim 8, wherein the magnetic permeability of the first region is lower than both the magnetic permeability of the second region and the magnetic permeability of the third region.

10. The magnetic coupling coil component of claim 8, wherein the insulating layer includes a plurality of insulating films stacked together, a first insulating film, which is one of the plurality of insulating films, has a conductive pattern constituting a part of the first coil conductor, the insulating layer further includes a fourth region disposed between the first region and the second region and including the first insulating film, and a magnetic permeability of the fourth region is lower than the magnetic permeability of the second region.

11. The magnetic coupling coil component of claim 8, wherein the insulating layer includes a plurality of insulating films stacked together, a second insulating film, which is one of the plurality of insulating films, has a conductive pattern constituting a part of the first coil conductor, the insulating layer further includes a fifth region disposed between the first region and the second region and including the second insulating film, and a magnetic permeability of the fifth region is lower than the magnetic permeability of the third region.

12. The magnetic coupling coil component of claim 8, wherein the first bottom coil surface of the first coil conductor contacts with the first region, and the second top coil surface of the second coil conductor contacts with the first region.

* * * * *